US009989319B2

(12) United States Patent
Kontu

(10) Patent No.: US 9,989,319 B2
(45) Date of Patent: Jun. 5, 2018

(54) PLATE HEAT EXCHANGER

(71) Applicant: VAHTERUS OY, Kalanti (FI)

(72) Inventor: Mauri Kontu, Kalanti As (FI)

(73) Assignee: VAHTERUS OY, Kalanti (FI)

( * ) Notice: Subject to any disclaimer, the term of this patent is extended or adjusted under 35 U.S.C. 154(b) by 376 days.

(21) Appl. No.: 14/351,738

(22) PCT Filed: Oct. 25, 2012

(86) PCT No.: PCT/FI2012/051024
§ 371 (c)(1),
(2) Date: Apr. 14, 2014

(87) PCT Pub. No.: WO2013/060939
PCT Pub. Date: May 2, 2013

(65) Prior Publication Data

US 2014/0311723 A1 Oct. 23, 2014

(30) Foreign Application Priority Data

Oct. 25, 2011 (FI) ..... 20116050

(51) Int. Cl.
*F28F 3/08* (2006.01)
*F28F 9/00* (2006.01)
*F28D 9/00* (2006.01)

(52) U.S. Cl.
CPC ..... *F28F 3/08* (2013.01); *F28D 9/0043* (2013.01); *F28F 9/005* (2013.01); *F28D 9/0006* (2013.01); *F28F 2230/00* (2013.01)

(58) Field of Classification Search
CPC .... F28D 9/0031; F28D 9/0037; F28D 9/0043; F28D 9/0062; F28D 9/0006; F28D 9/005;
(Continued)

(56) References Cited

U.S. PATENT DOCUMENTS 5,509,471 A * 4/1996 Hallgren ..... B01D 1/221 159/28.6
7,204,300 B2 4/2007 Kontu et al.
(Continued)

FOREIGN PATENT DOCUMENTS

DE 28 39 206 3/1980
WO WO 93/14363 7/1993
(Continued)

OTHER PUBLICATIONS

International Search Report for PCT/FI2012/051024, dated Apr. 19, 2013.
(Continued)

*Primary Examiner* — Grant Moubry
*Assistant Examiner* — Harry Arant
(74) *Attorney, Agent, or Firm* — Noxon & Vanderhye P.C.

(57) ABSTRACT

A Plate and Shell type plate heat exchanger, which comprises a plate pack, a shell surrounding the plate pack, and end plates mainly in the direction of the ends of the plate pack and inlet and outlet connections for a first heat exchange medium and a second heat exchange medium arranged through the end plate. The plate pack of the heat exchanger is arranged inside the shell in an acentric manner, so that the midpoint of the cross-section of the plate pack deviates substantially from the midpoint of the cross-section of the shell in the vertical direction and/or lateral direction of the cross-section.

12 Claims, 2 Drawing Sheets

Figure 1:
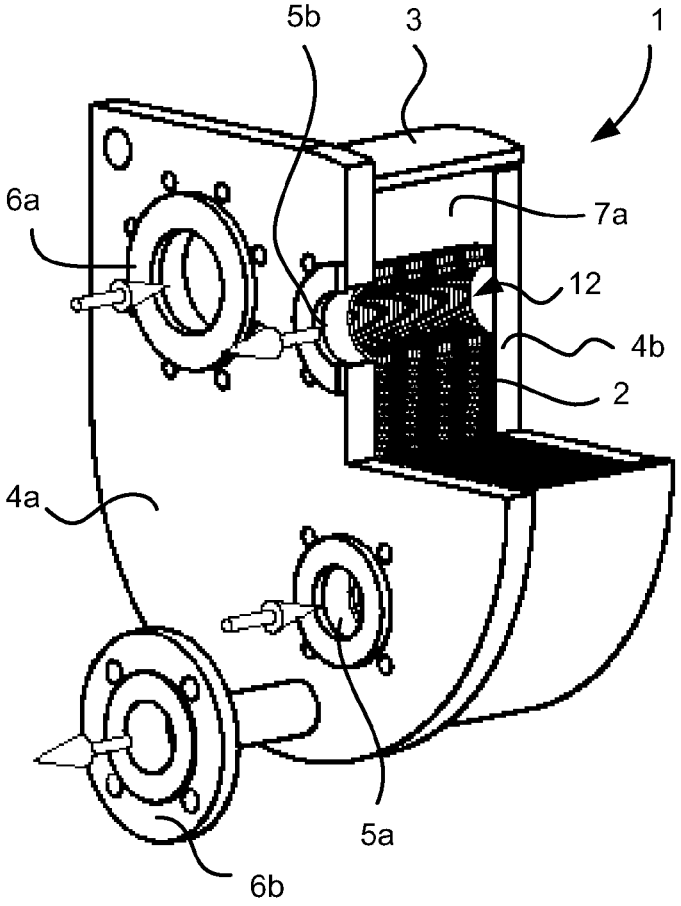

(58) Field of Classification Search
CPC .... F28F 3/08; F28F 3/083; F28F 3/086; F28F 9/005; F28F 2230/00; F28F 2235/00; F28F 2009/222; F28F 209/224; F28F 2009/224
USPC ..... 165/166, 167
See application file for complete search history.

(56) References Cited

U.S. PATENT DOCUMENTS

| | | | | |
|---|---|---|---|---|
| 7,347,253 | B2 | 3/2008 | Tauren et al. | |
| 7,472,563 | B2 | 1/2009 | Knoll | |
| 2003/0000688 | A1* | 1/2003 | Mathur | F28D 9/0006 165/167 |
| 2005/0011639 | A1* | 1/2005 | Kontu | F28D 9/0006 165/167 |
| 2005/0022982 | A1 | 2/2005 | Dilley et al. | |

FOREIGN PATENT DOCUMENTS

| | | | | |
|---|---|---|---|---|
| WO | WO 97/45689 | | 12/1997 | |
| WO | WO 9745689 | A1 * | 12/1997 | F28D 9/0012 |
| WO | WO 03/031896 | | 4/2003 | |
| WO | WO 03/060411 | | 7/2003 | |
| WO | WO 2004/090450 | | 10/2004 | |

OTHER PUBLICATIONS

Finland Search Report for FI Application No. 20116050, dated Aug. 21, 2012.

* cited by examiner

PLATE HEAT EXCHANGER

This application is the U.S. national phase of International Application No. PCT/FI2012/051024, filed 25 Oct. 2012, which designated the U.S. and claims priority to Finland Application No. 20116050, filed 25 Oct. 2011, the entire contents of each of which are hereby incorporated by reference.

OBJECT OF THE INVENTION

The object of the invention is a heat exchanger according to the preamble of the independent claim presented below.

BACKGROUND OF THE INVENTION

Plate and Shell type welded plate heat exchangers are previously known, which are composed of a plate pack formed by heat exchange plates and a shell surrounding it, functioning as a pressure vessel. The core of the heat exchanger is usually formed by a plate pack composed of circular heat exchange plates having openings, where the plates are welded tightly together at openings therein and/or at the perimeters of the plates. A primary circuit of the heat exchanger is formed between the openings in the plates into the plate pack and a secondary circuit between connections of the shell surrounding the plate pack, so that a primary side flow medium flows in every other plate space and a secondary side flow medium in every other plate space. In this type of heat exchangers the flow connections on the pack side are usually placed in the ends of, the heat exchanger and the flow connections on the shell side in the shell, whereby the pipe structures of the heat exchanger easily become complicated and expensive with regards to construction costs.

In some applications of the heat exchanger it is advantageous to place all connections in the end. Such a structure is presented for example in patent publication WO2004/090450, where the shell side flows are led to run via the end with separate Z components or corresponding arrangements arranged between the end plate of the plate pack and the end plate of the heat exchanger. Separate flow guides however make the structure of the heat exchanger more complicated and thus also make the manufacture of the heat exchangers more complicated.

OBJECT AND DESCRIPTION OF THE INVENTION

An object of the present invention is to present a structure of a Plate and Shell type plate heat exchanger, which reduces or even eliminates the above-mentioned problems.

An object of the present invention is to present a structure of a plate heat exchanger, where both the pack side and shell side flow connection/connections can be arranged in the end of the heat exchanger without needing separate guide components in the structure between the end plate of the plate pack and the end plate of the heat exchanger for guiding the flows on the shell side.

An object of the present invention is to present a structure of a heat exchanger, which is suitable for use especially in applications, where the heat-yielding and heat-receiving substance are in different states, such as in gas-liquid exchangers.

In order to attain this object, the heat exchanger according to the invention is primarily characterized in what is presented in the characterising part of the independent claim.

The other, dependent claims present some preferred embodiments of the invention.

A typical heat exchanger according to the invention comprises

- a plate pack formed of heat exchange plates having openings and arranged on top of each other, in which plate pack the heat exchange plates are attached to each other as plate pairs, the inner parts of which plate pairs are arranged in connection with each other via flow channels formed by the openings of the heat exchange plates,
- an outer casing surrounding the plate pack, which casing comprises end plates mainly in the direction of the ends of the plate pack and a shell connecting the end plates,
- inlet and outlet connections for a first heat exchange medium arranged through the end plate of the outer casing, which connections are arranged in connection with the inner parts of the plate pairs of the plate pack, and
- inlet and outlet connections for a second heat exchange medium arranged through the outer casing, which connections are arranged in connection with the inside of the shell, i.e. with the outside of the plate pack, and in which heat exchanger the plate pack is arranged inside the shell in an eccentric manner, so that the midpoint of the cross-section of the plate pack substantially deviates from the midpoint of the cross-section of the shell in the vertical direction and/or lateral direction of the cross-section, whereby the distance of the outer surface of the plate pack defined by the outer edges of the heat exchange plates from the inner surface of the shell is substantially different on opposite outer edges of the plate pack, and in which heat exchanger at least one inlet and outlet connection for the second heat exchange medium is arranged through the end plate of the outer casing, so that the connection opens into a space between the plate pack and the shell.

Now it has surprisingly been found that the outer dimensions of the shell of a Plate and Shell type heat exchanger in relation to the outer dimensions of the plate pack can be increased without weakening the heat exchange properties of the heat exchanger. In the heat exchanger structure according to the invention the shell surrounding the plate pack is to its dimensions substantially larger than the outer dimensions of the plate pack, due to which the plate pack can be arranged inside the shell in an eccentric manner in the lateral direction and/or vertical direction of the cross-section of the shell. In the heat exchanger according to the invention at least one plate pack is fitted inside the shell in an eccentric manner, which enables arranging at least one inlet or outlet connection for the heat exchange medium flowing on the shell side of the heat exchanger in the end plate of the heat exchanger so that the connection opens up directly into a space between the inner surface of the shell and the plate pack. Due to the eccentric placement of the plate pack, the shell side inlet and outlet connections are in the structure of the heat exchanger not situated by the plate pack, but they are directly in contact with the shell side, whereby separate flow guides are not needed between the plate pack and the end plate.

In the heat exchanger according to the invention at least one inlet and outlet connection on the shell side (for the second heat exchange medium) is, in addition to the pack side connections, arranged through the end plate of the heat exchanger. According to a preferred embodiment of the invention all the shell side inlet and outlet connections are arranged in the end structures of the heat exchanger. The inlet and outlet connections on the shell side, i.e. for the second heat exchange medium, are preferably arranged so that the connections open up into a space between the plate pack and the shell, whereby they are not situated by the plate pack. The pack side inlet and outlet connections are preferably arranged by the plate pack in the end structure.

In a typical heat exchanger according to the invention the shell of the heat exchanger is arranged at least mainly at a distance from the outer surface of the plate pack, and the distance of the outer surface of the plate pack defined by the outer edges of the heat exchange plates from the inner surface of the shell is substantially different on opposite outer edges of the plate pack. The distance between the inner surface of the shell of the heat exchanger and the outer surface of the plate pack can for example be 20-500 mm on the wider side of the plate pack, i.e. in the space between the plate pack and the shell, where the plate pack is farthest from the inner surface of the shell, and in which space at least one of the connections on the shell side i.e. for the second heat exchange medium opens up. The distance between the inner surface of the shell of the heat exchanger and the outer surface of the plate pack can for example be 5-10 mm in the smaller space between the plate pack and the shell. The diameter of the heat exchange plates can for example be in the range of 200-1400 mm.

In a typical heat exchanger according to the invention, the heat transfer surfaces consist of heat transfer plates attached to each other and collected into a plate pack, which have at least two flow openings for leading and removing a heat transfer medium through ducts formed by the plates. The plates of the heat exchanger are welded together into pairs at the outer perimeters of the heat exchange plates, and adjacent plate pairs are attached together by welding or otherwise combining the flow openings of two adjacent plate pairs together. Thus the first heat exchange medium can flow inside the plate pack from one plate pair to another via the flow openings. The second heat exchange medium is arranged to flow inside the shell in the spaces between the plate pairs. In the heat exchanger according to the invention the primary circuit of the heat exchanger is thus formed between the inlet and outlet connection of the first heat exchange medium, which connections are arranged in connection with the inner parts of the plate pairs of the plate pack, whereby the plate spaces of the primary circuit are inside the plate pairs of the plate pack. The secondary circuit of the heat exchanger is formed between the inlet and outlet connection of the second heat exchange medium, which connections are arranged in connection with the inside of the shell i.e. the outside of the plate pack, whereby the plate spaces of the secondary circuit are between adjacent plate pairs. Thus a primary side flow medium flows in every other plate space of the plate pack and a secondary side flow medium in the every other plate space.

In one embodiment of the invention the plate pack is composed of profiled heat exchange plates, which are stacked on top of each other and attached to each other, so that a heat-yielding heat exchange medium flows in every other plate space and a heat-receiving heat exchange medium in every other plate space. The height of the profile of the heat exchange plates determines, at least partly, the distance between the heat exchange plates, i.e. the size of the flow routes formed between the heat exchange plates.

In a preferred embodiment the heat exchanger according to the invention comprises a plate pack consisting of circular heat exchange plates, whereby the heat exchanger is mainly shaped like a circular cylinder. The plate pack is typically fitted inside a cylindrical shell part functioning as a pressure vessel. In a preferred embodiment the shell and plate pack of the heat exchanger according to the invention are thus shaped like circular cylinders, and the plate pack is situated inside the shell in an eccentric manner in relation to the shell.

In a preferred embodiment of the invention the outer diameter of the plate pack is typically 30-70% of the inner diameter of the cylindrical shell, and most typically 50-70% of the inner diameter of the cylindrical shell.

The plate pack and/or the shell surrounding the plate pack of the heat exchanger according to the invention can also have other shapes than circular cylinders. The plate pack and shell can be shaped independently of each other to be suitable for the purpose, so that the plate pack can be placed inside the shell in an eccentric manner, i.e. the midpoint of the cross-section of the shell deviates substantially from the midpoint of the cross-section of the plate pack. The cross-section of the plate pack is typically 30-70% of the cross-section of the shell.

In a heat exchanger according to a preferred embodiment of the invention a plate-like flow guide is arranged between the outer surface of the plate pack and the inner surface of the shell between the inlet and outlet connection of the second heat exchange medium (on the shell side) when seen from the direction of the end plate of the heat exchanger, which flow guide extends in the longitudinal direction from the first end plate of the outer casing of the heat exchanger to the second end plate. The flow guide is arranged between the plate pack and the shell on the wider side of the plate pack arranged in an eccentric manner, i.e. on the side, where the plate pack is farthest from the inner surface of the shell. With the aid of the flow guide, flow channels for the heat exchange medium can be formed on the shell side of the heat exchanger from the inlet connection to the plate pack and from the plate pack to the outlet connection. The flow guide is typically by its one side attached to the inner surface of the shell in the longitudinal direction of the shell, and a sealing component attached to the other side of the flow guide is arranged to press against the plate pack, so that the sealing component is arranged substantially over the entire length of the plate pack. A spring force generated by the plate-like flow guide presses the sealing component attached to the other side of the flow guide tightly against the plate pack. Alternatively the flow guide is arranged in the structure in the opposite way, i.e. the flow guide is attached to the plate pack and the sealing component is arranged on the side toward the shell. The flow guide preferably extends in the longitudinal direction of the shell and plate pack from the first end plate of the heat exchanger to the second end plate. The flow channels are thus formed to have the length of the entire plate pack. In an embodiment of the invention the flow guides are attached to the end plates of the heat exchanger. In a second embodiment of the invention the flow guides are arranged tightly against the end plates of the heat exchanger without being attached to the end plates in a fixed manner.

In a preferred embodiment of the invention a seal is arranged in the smaller space between the inner surface of the shell of the heat exchanger and the outer surface of the plate pack, the purpose of which seal is to close the space between the shell and the plate pack. The seal preferably extends in the longitudinal direction of the shell and plate pack from one end of the heat exchanger to the other end. The seal is typically a rubbery or corresponding seal.

In a heat exchanger according to the invention at least one corner of the end plate or end plates of the outer casing of the heat exchanger extends outside the outer shell of the heat exchanger, forming a corner, from which the heat exchanger can be attached to a machine unit or the like without separate attaching lugs. In a preferred embodiment of the invention at least one corner of the end plate/plates of the outer casing of the heat exchanger has been left unrounded, whereby it forms an attaching element of the circular plate heat exchanger.

The heat exchanger according to the invention can be used in liquid/liquid, liquid/gas and gas/gas applications. The heat exchanger according to the invention is preferably suitable for applications, where the shell side heat exchange medium is evaporated or condensed.

The heat exchanger structure according to the invention provides significant advantages. The flows of the primary and secondary sides can be divided in a desired manner, and the connections required by them can all be placed in the end/ends of the heat exchanger. In the heat exchanger according to the invention the flanges of the connections in the end plate can be fitted to the surface of the end plate or onto different levels in relation to the surface of the end plate, whereby the connections can be fitted closer to each other or connections with flanges can be fitted to overlap on the end plate. The eccentric placement of the plate pack inside the shell according to the invention makes possible an increase in the size of at least one shell side connection in the end. An increase in the connection size is advantageous especially in two-phase heat exchange applications, such as evaporators and condensers. In the heat exchanger according to the invention the heat exchange conditions can thus be freely selected, depending on the properties and flow rates of the heat transfer media. The heat exchanger according to the invention can function as a concurrent, counter-current or cross-flow heat exchanger. When all the inlet and outlet connections of the heat exchanger with plate structure are arranged in the end/ends of the heat exchanger, in its end plates, the installation work of the heat exchanger becomes easier and new possibilities are obtained for placing the heat exchanger.

In the heat exchanger according to the invention the plate pack arranged inside the shell in an eccentric manner also makes possible that the size of the outer shell of the heat exchanger can be freely selected according to the heat exchange application.

SHORT DESCRIPTION OF THE FIGURES

Figure 2:
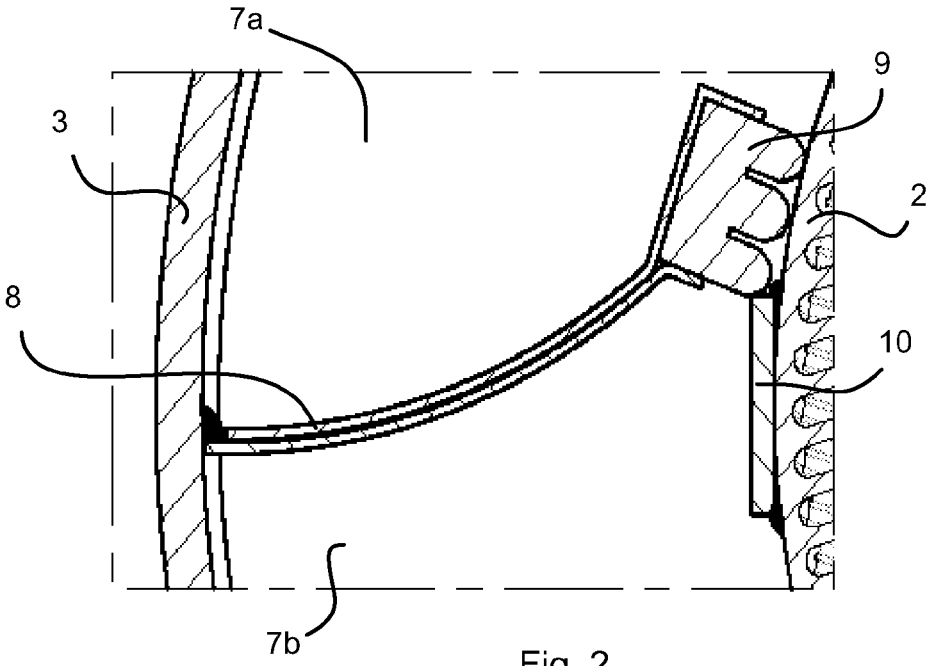
Figure 3:
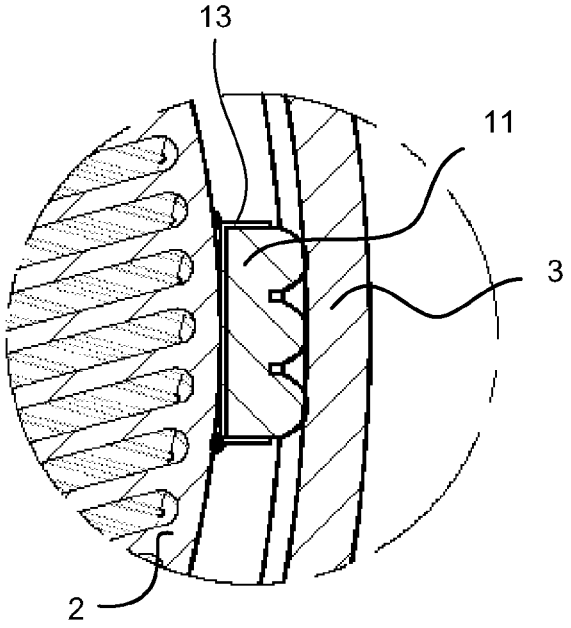
Figure 4:
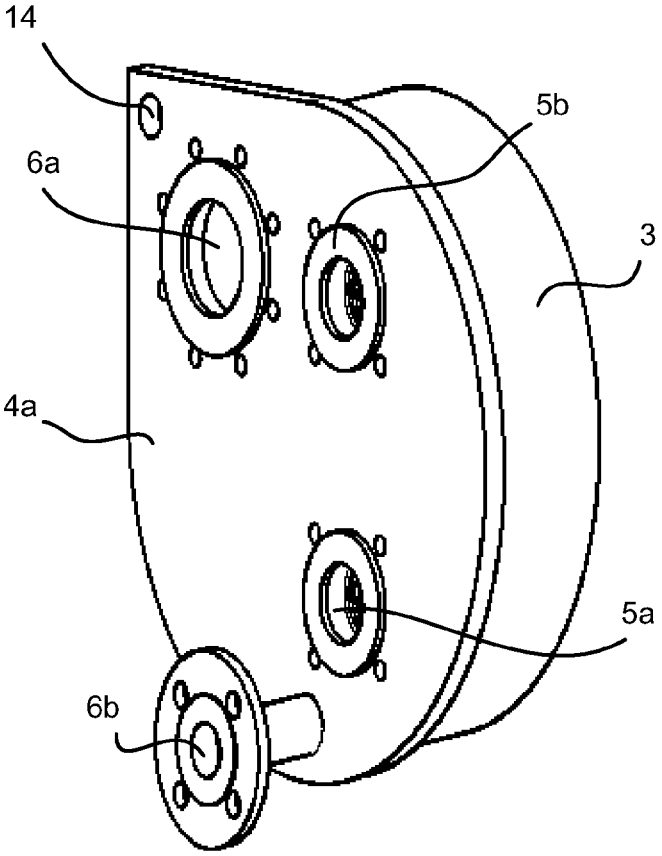

In the following, the invention will be described in more detail with reference to the appended drawings, in which FIG. 1 shows a heat exchanger according to the invention as partly opened, FIG. 2 shows a cross-section of a flow guide of a heat exchanger according to the invention, arranged between the shell and the plate pack, FIG. 3 shows a cross-section of a seal arranged between the plate pack and the shell, and FIG. 4 shows a heat exchanger according to the invention, where the shell side and pack side inlet and outlet connections are arranged through one of the end plates.

DETAILED DESCRIPTION OF THE INVENTION

FIG. 1 shows a heat exchanger according to the invention as partly opened, where the inlet and outlet connections of the first and second heat exchange medium are fitted into one end plate.

The outer casing of the heat exchanger 1 with plate structure, which outer casing functions as a pressure vessel, comprises end plates 4*a* and 4*b*, and a shell 3 connecting the end plates. A plate pack 2, which forms the heat exchange surfaces, is fitted inside the outer casing. The plate pack 2 is composed from circular heat exchange plates connected together and having openings, which plates are connected together in pairs by welding at the outer perimeters of the heat exchange plates, and adjacent plate pairs are joined together by connecting the flow openings of the heat exchange plates with each other, whereby flow channels are formed inside the plate pack (one flow channel 12 inside the plate pack is shown in the figure).

The heat exchange medium flowing inside the plate pack 2 forms a primary flow, which is led into the plate pack 2 through the end plate 4*a* via an inlet connection 5*a* and removed via an outlet connection 5*b* in the end 4*a*, and which connections 5*a*, 5*b* are in contact with the inner parts of the plate pack, i.e. with the inner parts of the plate pairs.

The heat exchange medium flowing to the shell side of the heat exchanger forms the secondary flow, which is led to the heat exchanger via an inlet connection 6*a* arranged in the end plate 4*a*. The shell side flow flows via a flow channel 7*a* to the plate pack 2 and is removed from the heat exchanger 1 via an outlet connection 6*b* arranged in the end plate 4*a*. The secondary circuit of the heat exchanger is formed between the second inlet and outlet connection 6*a*, 6*b* of the shell side.

The passage of the primary and secondary flow is illustrated in FIG. 1 with arrows.

The inlet and outlet connections 5*a*, 5*b*, 6*a*, 6*b* shown in FIG. 1 are presented only as examples, the connections can depending on their use purpose comprise different flange structures.

If the heat exchanger shown in FIG. 1 functions as a condenser, the steam flow is led onto the plate pack 2 into the shell part via a steam connection 6*a* with a large diameter. The condensate is removed from the bottom of the shell via a condensate connection 6*b*. The cooling heat exchange medium, preferably a liquid, is led into the plate pack 2 via an inlet connection 5*a* and out of the plate pack via an outlet connection 5*b*.

FIG. 2 shows a cross-section of a plate-like flow guide 8, which is fitted between the shell 3 and the plate pack 2 inside the shell part on the wider side of the plate pack 2 placed in an eccentric manner. One edge of the flow guide 8 is attached by welding or in a corresponding manner to the inner surface of the shell 3. A rubber seal or the like 9 is attached to the end of the flow guide 8 toward the plate pack 2, which seal presses against the outer surface of the plate pack 2 and preferably also against a flat bar iron 10 or the like attached in a longitudinal manner to the plate pack 2. The flow guide 8 is formed from a flexible plate or plates, which are bent so that due to spring force, the second edge of the flow guide 8 presses against the outer perimeter of the plate pack 2. The purpose of the flow guide 8 is to guide the flow of the shell side heat exchange medium from the inlet connection 6*a* via the flow channel 7*a* to the plate pack 2, and correspondingly guide the flow from the plate pack 2 via the flow channel 7*b* to the outlet connection 6*b*.

FIG. 3 shows a cross-section of a seal 11 fitted between the outer surface of the plate pack 2 and the inner surface of the shell 3, which seal 11 is arranged inside the shell part in the smaller space between the eccentric plate pack 2 and the shell 3. The sealing rubber 11 is installed into place with the aid of a support component 13 attached to the shell 3 or pack 2 and bent from a plate.

FIG. 4 shows an end plate 4*a* of a heat exchanger according to the invention, through which end plate both the shell side and pack side inlet and outlet connections 5*a*, 5*b*, 6*a*, 6*b* are arranged. The connections arranged in the end plate can be flanged pipe connections, flange connections fitted into the end plate and/or pipe connections to be welded. By placing the flanges on different levels, the distances between the connection holes can be decreased.

FIG. 4 also shows that at least one corner of the end plate 4*a* of the heat exchanger can be left unrounded. This corner extending outside the shell 3 of the heat exchanger can be provided with a hole 14 or another corresponding structure, whereby the end plate 4*a* can be used as a support element of the heat exchanger and no separate attaching lugs are needed.

The invention is not intended to be limited to the above-presented exemplary embodiments, but the intention is to apply the invention widely within the inventive idea defined by the claims defined below.

The invention claimed is:

1. A heat exchanger comprising:

a plate pack formed of circular heat exchange plates having outer edges defining an outer surface of the plate pack, wherein the heat exchange plates are stacked on top of and attached to one another to form respective plate pairs, the respective plate pairs including a pair of openings which define respective inlet and outlet primary flow channels for a first heat exchange medium within an inner part of the plate pairs of the plate pack, an outer casing surrounding the plate pack, wherein the outer casing comprises first and second end plates respectively positioned adjacent opposed ends of the plate pack, and a cylindrical shell connecting the opposed pair of end plates, wherein the plate pack is eccentrically positioned within the shell of the outer casing relative to a cross-sectional mid-point of the shell so as to establish a shell-side space between the outer surface of the plate pack and an inner surface of the shell, wherein distances between the outer surface of the plate pack and the inner surface of the shell differ substantially at circumferentially different locations of the outer edges of the plate pack and thereby establish diametrically opposed locations of the shell-side space having greatest and least distances between the outer surface of the plate pack and the inner surface of the shell, and wherein the heat exchanger further comprises:

a sealing assembly which includes respective first and second rubber seals extending in a longitudinal direction of the heat exchanger between the first and second end plates at the diametrically opposed locations of the shell-side space having the greatest and least distances between the outer surface of the plate pack and the inner surface of the shell, respectively;

primary inlet and outlet connections arranged through the first end plate of the outer casing for the first heat exchange medium so as to open directly into the inlet and outlet primary flow channels within the inner part of the plate pairs of the plate pack, and secondary inlet and outlet connections for a second heat exchange medium arranged through the first end plate so as to open directly into the shell-side space defined between the outer surface of the plate pack and the inner surface of the shell, wherein a first connection of the secondary inlet and outlet connections for the second heat exchange medium is positioned through the first end plate of the outer casing so that the first connection opens directly into the shell-side space between the outer surface of the plate pack and the inner surface of the shell at a first location of the shell-side space having a first distance between the outer surface of the plate pack and the inner surface of the shell, and wherein a second connection of the secondary inlet and outlet connections for the second heat exchange medium is positioned through the first end plate of the outer casing so that the second connection opens directly into the shell-side space between the outer surface of the plate pack and the inner surface of the shell at a second location of the shell-side space having a second distance between the outer surface of the plate pack and the inner surface of the shell which is less than the first distance.

2. The heat exchanger according to claim 1, wherein the plate pack has an outer diameter which is 30-70% of an inner diameter of the cylindrical shell.

3. The heat exchanger according to claim 2, wherein the outer diameter of the plate pack 50-70% of the inner diameter of the cylindrical shell.

4. The heat exchanger according to claim 1, wherein the greatest distance of the shell-side space between the outer surface of the plate pack and the inner surface of the shell ranges from 20-500 mm.

5. The heat exchanger according to claim 1, wherein the least distance of the shell-side space between the outer surface of the plate pack and the inner surface of the shell ranges from 5-10 mm.

6. The heat exchanger according to claim 1, wherein the sealing assembly comprises a lengthwise flow guide plate positioned between the outer surface of the plate pack and the inner surface of the shell at a location between the inlet and outlet connection for the second heat exchange medium, the flow guide plate extending in a longitudinal direction of the heat exchanger from the first end plate to the second end plate so as to establish respective first and second subspaces of the shell-side space.

7. The heat exchanger according to claim 6, wherein the flow guide plate includes proximal and distal ends, wherein the proximal end is welded to the inner surface of the shell in the longitudinal direction of the heat exchanger, and wherein the distal end of the flow guide plate carries the first rubber seal and is unconnected to an adjacent portion of the outer surface of the plate pack, the flow guide plate being curved between the first and second ends so as to cause the first rubber seal carried at the distal end thereof to be sealingly pressed against an adjacent portion of the outer surface of the plate pack.

8. The heat exchanger according to claim 1, wherein at least the first end plate includes at least one corner which extends beyond an exterior surface of the shell.

9. The heat exchanger according to claim 7, further comprising a bar attached to the adjacent portion of the outer surface of the plate pack in the longitudinal direction of the heat exchanger, wherein the second rubber seal presses against the bar and an adjacent portion of the outer surface of the plate pack in the longitudinal direction of the heat exchanger.

10. A heat exchanger comprising:

a plate pack formed of circular heat exchange plates having outer edges defining an outer surface of the plate pack, wherein the heat exchange plates are stacked on top of and attached to one another to form respective plate pairs, the respective plate pairs including a pair of openings which define respective inlet and outlet primary flow channels for a first heat exchange medium within an inner part of the plate pairs of the plate pack, an outer casing surrounding the plate pack, wherein the outer casing comprises first and second end plates respectively positioned adjacent opposed ends of the plate pack, and a cylindrical shell connecting the opposed pair of end plates, wherein the plate pack is eccentrically positioned within the shell of the outer casing relative to a cross-sectional mid-point of the shell so as to establish a shell-side space between the outer surface of the plate pack and an inner surface of the shell, wherein distances between the outer surface of the plate pack and the inner surface of the shell differ substantially at circumferentially different locations of the outer edges of the plate pack and thereby establish diametrically opposed locations of the shell-side space having respective greatest and least distances between the outer surface of the plate pack and the inner surface of the shell, and wherein the heat exchanger further comprises:

primary inlet and outlet connections arranged through the first end plate of the outer casing for the first heat exchange medium so as to open directly into the inlet and outlet primary flow channels within the inner part of the plate pairs of the plate pack, secondary inlet and outlet connections for a second heat exchange medium arranged through the first end plate so as to open directly into the shell-side space defined between the outer surface of the plate pack and the inner surface of the shell, and a sealing assembly which includes respective first and second rubber seals extending in a longitudinal direction of the heat exchanger between the first and second end plates at the diametrically opposed locations of the shell-side space having the greatest and least distances between the outer surface of the plate pack and the inner surface of the shell, respectively, wherein the sealing assembly comprises:

(a) a bar attached to the outer surface of the plate pack in the longitudinal direction of the heat exchanger; and (b) a lengthwise flow guide plate positioned between the outer surface of the plate pack and the inner surface of the shell at a location between the inlet and outlet connection for the second heat exchange medium so as to establish respective first and second subspaces of the shell-side space, the flow guide plate extending in a longitudinal direction of the heat exchanger from the first end plate to the second end plate, the flow guide plate including:

(i) a proximal end that is welded to the inner surface of the shell so as to be rigidly attached to the shell in the longitudinal direction of the shell, and (ii) a distal end opposite to the proximal end, the distal end having a terminal edge that extends in the longitudinal direction of the heat exchanger which is unconnected to the bar and to an adjacent portion of the outer surface of the plate pack to which the bar is attached, wherein (iii) the first rubber seal is attached to and carried by the terminal edge of the flow guide plate so as to be positioned in the longitudinal direction of the heat exchanger between the terminal edge of the flow guide plate and the adjacent portion of the outer surface of the plate pack at a first one of the diametrically opposed locations, and wherein the flow guide plate is flexible and curved between the proximal and distal ends thereof so as to exert a spring force at the terminal edge of the flow guide plate to thereby press the first rubber seal into sealing contact in the longitudinal direction of the heat exchanger with the adjacent portion of the outer surface of the plate pack and the bar at the first one of the diametrically opposed locations.

11. The heat exchanger according to claim 10, wherein a first connection of the secondary inlet and outlet connections for the second heat exchange medium is positioned through the first end plate of the outer casing so that the first connection opens directly into the first subspace of the shell-side space between the outer surface of the plate pack and the inner surface of the shell at a first location of the shell-side space having a first distance between the outer surface of the plate pack and the inner surface of the shell.

12. The heat exchanger according to claim 11, wherein a second connection of the secondary inlet and outlet connections for the second heat exchange medium is positioned through the first end plate of the outer casing so that the second connection opens directly into the second subspace of the shell-side space between the outer surface of the plate pack and the inner surface of the shell at a second location of the shell-side space having a second distance between the outer surface of the plate pack and the inner surface of the shell which is less than the first distance.

* * * * *